US007637601B2

(12) United States Patent
Oya et al.

(10) Patent No.: US 7,637,601 B2
(45) Date of Patent: Dec. 29, 2009

(54) DROPLET DISCHARGING HEAD, DROPLET DISCHARGING APPARATUS, METHOD FOR MANUFACTURING DROPLET DISCHARGING HEAD AND METHOD FOR MANUFACTURING DROPLET DISCHARGING APPARATUS

(75) Inventors: Kazufumi Oya, Suwa (JP); Katsuji Arakawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 385 days.

(21) Appl. No.: 11/778,276

(22) Filed: Jul. 16, 2007

(65) Prior Publication Data

US 2008/0043068 A1 Feb. 21, 2008

(30) Foreign Application Priority Data

Aug. 18, 2006 (JP) ..... 2006-223001

(51) Int. Cl.
*B41J 2/045* (2006.01)

(52) U.S. Cl. ..... 347/70

(58) Field of Classification Search ..... 347/70, 347/68–69, 71–72; 400/124.14–124.17, 400/124.23; 310/323.06, 323.08, 324, 330, 310/331; 29/25.35

See application file for complete search history.

(56) References Cited

U.S. PATENT DOCUMENTS

2006/0092239 A1* 5/2006 Sung et al. ..... 347/71
2007/0263041 A1* 11/2007 Owaki ..... 347/71
2008/0129799 A1* 6/2008 Lee et al. ..... 347/71

FOREIGN PATENT DOCUMENTS

JP 02-059769 2/1990
JP 11-115179 4/1999

* cited by examiner

*Primary Examiner*—K. Feggins
(74) *Attorney, Agent, or Firm*—Workman Nydegger

(57) ABSTRACT

A droplet discharging head includes: a nozzle substrate that has a plurality of nozzle holes; a cavity substrate that communicates with the nozzle holes and which has a plurality of independent discharge chambers, the discharge chambers generating pressure therein so as to discharge droplets through the nozzle holes; a reservoir substrate that has a reservoir concave section and is provided between the nozzle substrate and the cavity substrate, the reservoir concave section functioning a reservoir, the reservoir being shared for communicating with the discharge chambers; a resin thin film formed on an entire inner surface of the reservoir concave section by film deposition, the resin thin film not being formed in the reservoir substrate on a side of an adhesion interface with the nozzle substrate or the cavity substrate; and a bottom surface of the reservoir concave section functioning a diaphragm section, the diaphragm section including the resin thin film and buffering pressure fluctuation.

16 Claims, 14 Drawing Sheets

DROPLET DISCHARGING HEAD, DROPLET DISCHARGING APPARATUS, METHOD FOR MANUFACTURING DROPLET DISCHARGING HEAD AND METHOD FOR MANUFACTURING DROPLET DISCHARGING APPARATUS

BACKGROUND

1. Technical Field

The present invention relates to a droplet discharging head, a droplet discharging apparatus, a method for manufacturing a droplet discharging head and a method for manufacturing a droplet discharging apparatus.

2. Related Art

For example, an inkjet head mounted in an inkjet recording apparatus is known as a droplet discharging head for discharging droplets. The inkjet head generally includes a nozzle substrate in which a plurality of nozzle holes for discharging ink drops are formed, a discharge chamber which is joined to the nozzle substrate and which communicates with the nozzle substrate through the nozzle holes, and a cavity substrate in which an ink flow path such as a reservoir is formed. The inkjet head is structured such that ink drops are discharged by pressure being applied by a drive section to the discharge chamber. Drive means includes a type of utilizing electrostatic force, a piezoelectric type using a piezoelectric element, and type of utilizing a heating element.

Among inkjet heads as described above, there is a demand for an inkjet head with a structure having a plurality of nozzle arrays to achieve high-speed printing and color printing. Furthermore, along with recent increase in nozzle density and increase in length of the ink jet (i.e., the number of nozzles per array), the number of actuators in the inkjet head has been more and more increased.

A reservoir which is common to the discharge chambers and which communicates with individual discharge chambers is provided in the inkjet head. Accordingly with an increase in nozzle density pressure of a discharge chambers is transmitted also to the reservoir, and thus the pressure also affects other discharge chambers and the nozzle holes which communicate with the other discharge chambers. For example, when positive pressure is applied to the reservoir by driving of the actuator, ink drops leak from non-driven nozzles which are not the nozzle holes (i.e., driven nozzles) through which the ink drops should be discharged. On the other hand, when negative pressure is applied to the reservoir, the amount of ink drops which should be discharged from the driven nozzles decreases. As a result, printing quality is deteriorated.

To prevent pressure interference between the nozzles as described above, there have been disclosed arts of assembling a unit referred to as an ink distribution plate having a diaphragm section to a member in which the nozzles are formed. (For example, refer to FIGS. 1 and 2 in Page 1, JP-B-2-59769.)

However, in the art disclosed in JP-B-2-59769, the ink distribution plate is separately assembled in the member in which the nozzles are formed, and therefore it is difficult to reduce the size and thickness of the inkjet head.

To overcome this disadvantage, inkjet heads have been disclosed in which a diaphragm section for buffering pressure fluctuation in the reservoir is provided in the nozzle substrate. (For example, see FIGS. 1 and 2 in Page 2, JP-A-11-115179).

In the inkjet head disclosed in JP-A-11-115179, however, since the reservoir and the discharge chamber are formed in the same substrate (the cavity substrate), it is difficult to provide a diaphragm section and the reservoir in the same substrate from the viewpoint of securing the volume of the reservoir. Accordingly this structure causes a section with insufficient strength to be exposed to the outside despite the fact that the diaphragm section is formed in the nozzle substrate. Therefore, there is a limit in reducing the thickness of the diaphragm section, and a protective cover or the like is separately needed.

SUMMARY

An advantage of the invention is to provide a droplet discharging head, a droplet discharging apparatus, a method for manufacturing a droplet discharging head and a method for manufacturing a droplet discharging apparatus which enable increasing density of the nozzles and preventing pressure interference between the nozzles.

According to an aspect of the invention, a droplet discharging head includes: a nozzle substrate which has a plurality of nozzle holes; a cavity substrate which communicates with the nozzle holes and which has a plurality of independent discharge chambers, the discharge chambers generating pressure therein so as to discharge droplets through the nozzle holes; a reservoir substrate which has a reservoir concave section and which is provided between the nozzle substrate and the cavity substrate, the reservoir concave section functioning a reservoir, the reservoir being shared for communicating with the discharge chambers; a resin thin film formed on an entire inner surface of the reservoir concave section by film deposition, the resin thin film not being formed in the reservoir substrate on a side of an adhesion interface with the nozzle substrate or the cavity substrate; and a bottom surface of the reservoir concave section functioning a diaphragm section, the diaphragm section including the resin thin film and buffering pressure fluctuation.

Since the diaphragm section and the discharge chamber are provided in the separate substrates (the reservoir substrate and the cavity substrate), the volume of the reservoir can be secured and the diaphragm section can be provided in the reservoir. This enables densification of nozzles and suppresses pressure fluctuation in the reservoir by reducing compliance of the reservoir, thereby preventing pressure interference between the nozzles which is generated when ink is discharged. As a result of this, good discharge property can be obtained.

In addition, making the entire bottom surface of the reservoir a diaphragm enables increasing an area of the diaphragm section, thereby increasing a pressure buffering effect of the diaphragm section.

In addition, the resin thin film is not formed on the adhesion interfaces of the reservoir substrate with the nozzle substrate or the cavity substrate. Accordingly decrease in adhesive strength with the nozzle substrate or the cavity substrate caused by the resin thin film being interposed in the adhesion interface.

In addition, since the resin thin film is formed on the entire inner surface of the reservoir concave section, a sufficient contact area between the resin thin film and the reservoir substrate can be secured, and thus sufficient adhesiveness can be secured.

In this case, a side opposite to the reservoir concave section of the reservoir substrate at the section of the resin thin film which includes the bottom surface of the reservoir concave section functions a space section which be formed by engraving the surface opposite to the surface in which the reservoir concave section is formed into the diaphragm section.

Since the structure is such that the diaphragm section is provided in the reservoir substrate, the diaphragm section is sandwiched between the nozzle substrate and the cavity substrate and no external force is applied thereto. Accordingly the thickness of the diaphragm section can be reduced and strength against external force of the head unit can be enhanced without a need for a special protective member such as a protective cover.

Since both sides of the diaphragm section function the space section vibration displacement of the diaphragm section is enabled in the space section.

In addition, since the space section used for deformation of the diaphragm section need not be processed in the cavity substrate or the nozzle substrate, effect on design and processing of the cavity substrate or the nozzle substrate can be eliminated.

In this case, the resin thin film may be made of parylene.

As a result of this, a resin thin film free from minute defects and with good coating characteristics, heat-resistance, chemical resistance and vapor resistance can be formed. Furthermore, a high pressure absorption effect can be provided since the resin thin film is more flexible compared to, for example, a silicon film.

In this case, a metal thin film may be formed as an underlayer of the resin thin film.

In this case, the metal thin film may be a platinum film.

As a result of this, adhesiveness between parylene and the reservoir substrate surface can be enhanced.

In this case, the space section may be provided in the reservoir substrate on a side of an adhesion interface with the cavity substrate.

Since the space section used for deformation of the diaphragm section is provided on the side of the adhesion interface with the cavity substrate, the reservoir concave section of the reservoir substrate is located on the side of the nozzle substrate, and the reservoir is vertically overlapped with the discharge chamber of the cavity substrate, whereby the size of the head area can be reduced.

In this case, the space section may be provided in the reservoir substrate on a side of an adhesion interface with the nozzle substrate.

Since the space section used for deformation of the diaphragm section is provided on a side of the adhesion interface with the nozzle substrate, the reservoir concave section of the reservoir substrate is located on the side of the cavity substrate, and thus all processing on the reservoir substrate can be complete with processing on the single side, that is, only on the side of the cavity substrate.

In this case, a droplet discharging apparatus may include either one of the droplet discharging heads as described above.

As a result, a droplet discharging apparatus including a droplet discharging head which prevents pressure interference generated between the nozzles when ink is discharged and which has good discharge property can be obtained.

According to another aspect of the invention, a method for manufacturing a droplet discharging head including: a nozzle substrate which has a plurality of nozzle holes; a cavity substrate which has a plurality of independent discharge chambers, the discharge chambers communicating with the nozzle holes respectively and generating pressure therein so as to discharge droplets through the nozzle holes; a reservoir substrate which has a reservoir and which is provided between the nozzle substrate and the cavity substrate, the reservoir being shared for communicating with the discharge chambers; and a diaphragm section which includes a resin thin film in a bottom surface of the reservoir, the resin thin film buffering pressure fluctuation, includes: forming a reservoir concave section which functions the reservoir by wet etching on a surface on one side of a silicon base material which functions the reservoir base material; covering a surface of a section other than an aperture section of the reservoir concave section on one side and the opposite side of the silicon base material with a mask material so as to form a resin thin film on an entire inner surface of the reservoir concave section; removing the mask material; and removing the silicon base material by dry etching on the surface on the opposite side until the resin thin film is exposed so as to form the diaphragm section.

According to the method described above, when forming the diaphragm section, a part of the resin thin film formed on the surface of the reservoir substrate by deposition is utilized as the diaphragm section as it is. Accordingly there is no need for process of partially removing the resin thin film or partially forming the resin thin film by deposition, thereby making the manufacturing process easy In addition, since the resin thin film is formed only in the inner surface of the reservoir concave section, decrease in adhesive strength caused by the resin thin film being interposed in the adhesion interface of the reservoir substrate with the nozzle substrate or the cavity substrate can be prevented.

In this case, the step of forming the resin thin film may be a step of depositing parylene.

As a result of this, a resin thin film free from minute defects and with high heat-resistance, chemical resistance and vapor resistance can be formed reliably in a desired portion with good coating performance. In addition, since the resin thin film is more flexible compared to, for example, a silicon film, a droplet discharging head having a high pressure absorption effect can be manufactured.

In this case, the mask material which covers the one side of the silicon base material may have an aperture only at a position opposed to the aperture section of the reservoir concave section, and the aperture may be smaller than the aperture section of the reservoir concave section.

As a result of this, should there be a displacement in the alignment of the mask material with respect to the reservoir base material, the adhesion interface of the reservoir substrate with the nozzle substrate is reliably protected by the mask material, and formation of the resin thin film by deposition on the adhesion interface can be reliably prevented. This secures adhesive strength between the reservoir substrate and the nozzle substrate.

In this case, the method for manufacturing a droplet discharging head may further include forming a metal thin film by deposition as an underlayer film before forming a parylene film by deposition.

In this case, the metal thin film may be a platinum film.

As a result of this, adhesiveness between parylene and the reservoir substrate surface can be enhanced.

In this case, a surface of the parylene thin film may be hydrophilic treated with oxygen plasma.

As a result of this, hydrophilicity of the ink flow path can be readily secured.

In this case, SF6 plasma may be used for the dry etching of silicon which is carried out when forming the diaphragm section.

As a result of this, dry etching of silicon can be carried out reducing the damage to the resin thin film to the minimum.

In this case, a droplet discharging apparatus may be manufactured applying either one of the methods for manufacturing a droplet discharge head as described above.

A droplet discharging apparatus including a droplet discharging head with good discharge property can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
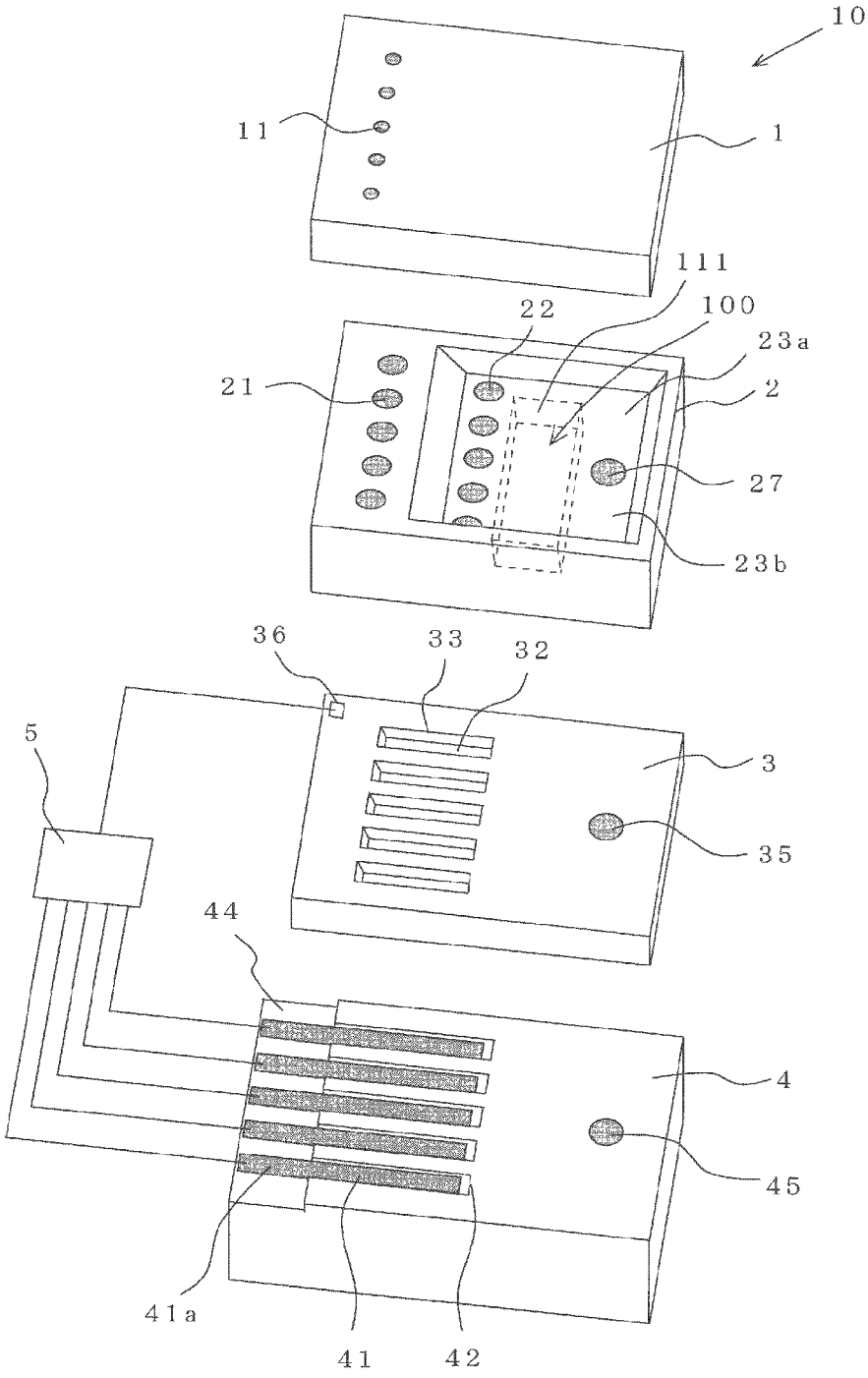
FIG. 1 is an exploded perspective view showing a schematic structure of the inkjet head according to Embodiment 1 of the invention.

Embodiments of a droplet discharging head which applies the invention will now be described. Here, an inkjet head of a face-discharge type which discharges an ink drop from nozzle holes provided in the surface of a nozzle substrate will be explained as an example of droplet discharging heads. Note that the invention is not limited to the structures and shapes shown in the drawings described below, and the invention can also be applied to a droplet discharging head of an edge-discharge type which discharges an ink drop from nozzle holes provided in the end of the substrate in a similar way Furthermore, although an actuator of an electrostatic-drive type is described herein, an actuator of other drive types may also be used.

Embodiment 1

Figure 2:
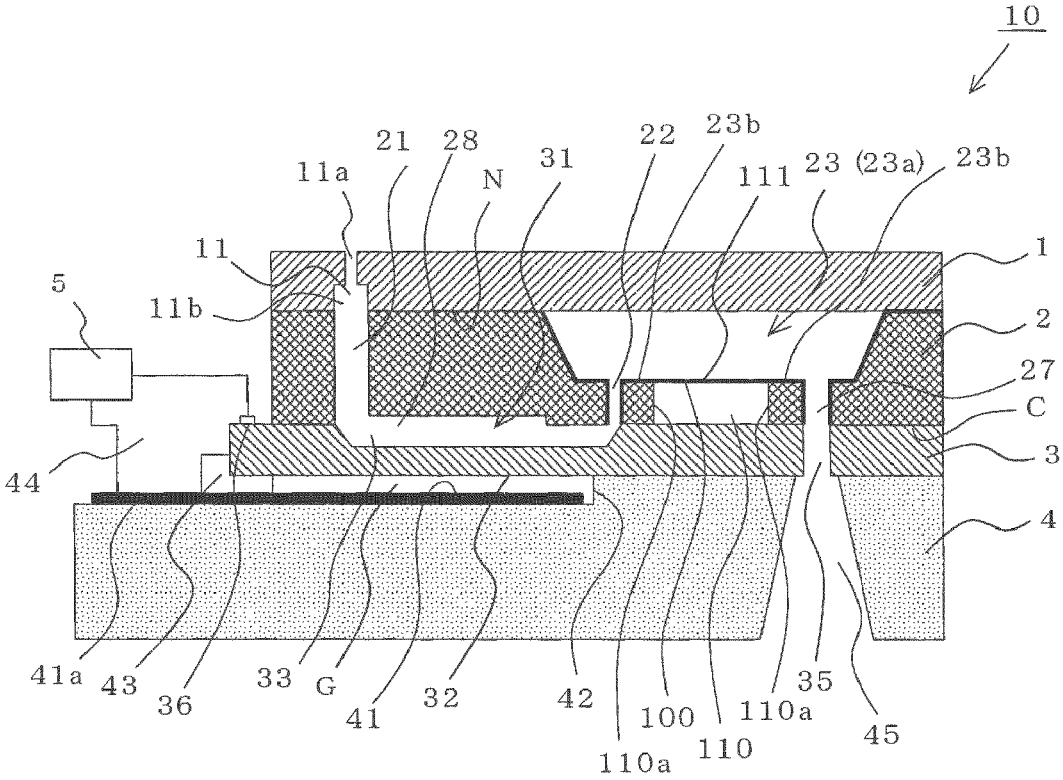
FIG. 2 is a sectional view showing an assembled state of the inkjet head shown in FIG. 1.

FIG. 1 is an exploded perspective view showing a schematic structure of an inkjet head according to Embodiment 1 of the invention, and FIG. 2 is a longitudinal sectional view showing an assembled state of the inkjet head shown in FIG. 1. FIGS. 1 and 2 show the inkjet head upside down from the state where it is normally used.

In FIGS. 1 and 2, an inkjet head (an example of the droplet discharging head) 10 is structured in a four-layer structure in which four substrates: a nozzle substrate 1, a reservoir substrate 2, a cavity substrate 3, an electrode substrate 4 are laminated on each other, rather than in a three-layer structure in which three substrates: a nozzle substrate, a cavity substrate and an electrode substrate are laminated on each other as in a conventional and general inkjet head of an electrostatic-drive type. In other words, a discharge chamber and a reservoir are provided in separate substrates according to the invention. Hereinafter, the structure of each substrate will be explained in detail.

The nozzle substrate 1 is made of, for example, a silicon material of thickness approx. 50 μm. A number of nozzle holes 11 are provided in the nozzle substrate 1 at a predetermined interval. In FIG. 1, 5 nozzle holes 11 in a single array are shown for simplicity Alternatively nozzles may be arranged in a plurality of arrays.

Each nozzle hole 11 includes an injection port section 11*a* which is a small hole and an introduction port section 11*b* which has a larger diameter. The injection port section 11*a* and the introduction port section 11*b* are coaxial and perpendicular to the substrate plane.

The reservoir substrate 2 is made of, for example, a silicon material of thickness approx. 180 μm and surface orientation (100). In the reservoir substrate 2, provided are nozzle communication holes 21 which have a slightly larger diameter (equivalent to or larger than the diameter of the introduction port section 11*b*) and which vertically penetrate the reservoir substrate 2 and independently communicate with the respective nozzle holes 11. In addition, a reservoir concave section 23*a* which functions a common reservoir (common ink chamber) is formed communicating each nozzle communication hole with each nozzle holes 11 through each supply port 22.

The reservoir concave section 23*a* has a substantially inverted trapezoid section which is opened to an adhesion interface with the nozzle substrate 1 (hereinafter also referred to as N surface) with the diameter being larger on the side of the adhesion interface. In addition, a bottom wall 23*b* of the reservoir concave section 23*a* on the side opposite to the cavity substrate 3 functions a space section 110 which penetrates to an adhesion interface between the reservoir substrate 2 and the cavity substrate 3 (hereinafter also referred to as C surface).

In addition, a resin thin film 111 is formed on the entire surface of the surface of the reservoir substrate 2 in which the reservoir concave section is formed (hereinafter referred to as the entire inner surface of the reservoir concave section 23*a*), except the adhesion interface between the reservoir substrate 2 and the cavity substrate 3 and except an inner periphery of the nozzle communication hole 21. Of the resin thin film, a resin thin film section opposed to the space section 110 constitutes a part of the bottom surface of the reservoir concave section 23*a* which has a diaphragm section 100 serving as a pressure fluctuation buffering section. In other words, the resin thin film 111 at the section opposed to the space section 110 is floated in the air between the space section 110 and the reservoir concave section 23*a*. The space section 110 permits deflection of the resin thin film 111.

The resin thin film 111 is formed by deposition in a process of manufacturing the reservoir substrate 2. It is formed using, for example, parylene.

The supply ports 22 as described above and an ink supply hole 27 are formed in so as to penetrate the bottom wall 23*b* of the reservoir concave section 23*a* at positions where they do not interfere with the diaphragm section 100. The ink supply hole 27 supplies ink for the reservoir 23 from the outside.

In addition, a narrow-ditch shaped second concave section 28 which constitutes a part of the discharge chamber 31 is formed in the C surface of the reservoir substrate 2. The second concave section 28 is herein provided for preventing increase in flow resistance in the discharge chamber 31 caused by reducing the thickness of the cavity substrate 3. However, the second concave section 28 may be omitted.

Note that a metal thin film, although not shown herein, is formed on the entire inner surface of the reservoir concave section 23*a* of the reservoir substrate 2 as an underlayer of the resin thin film 111. A platinum film is used for the metal thin film in the present embodiment. Formation of the metal thin film as the underlayer of the resin thin film 111 enables enhancing adhesiveness between the resin thin film 111 and the reservoir substrate 2 (silicon surface).

The nozzle communication hole 21 which penetrates the reservoir substrate 2 is provided coaxially with the nozzle hole 11 of the nozzle substrate 1, which provides linear property in discharging ink drop, thereby significantly enhancing discharge property Especially this structure enables a minute ink drop to reach a targeted position precisely a delicate shade change can be reproduced faithfully without producing color drift or the like, and a clearer display property of higher quality can be realized.

The cavity substrate 3 is made, for example, of a silicon material of thickness approx. 30 μm. In the cavity substrate 3, provided is a first concave section 33 which functions the discharge chamber 31 which independently communicates with each of the nozzle communication holes 21. In addition, the first concave section 33 and the second concave section 28 form and define each of the discharge chambers 31. In addition, a bottom wall of the discharge chamber 31 (first concave section 33) includes a vibrating plate 32. The vibrating plate 32 can be made a boron diffusion layer formed by diffusing boron in high concentration. Since the vibrating plate 32 is made of a boron diffusion layer, effective wet etching is achieved, thickness and surface roughness of the vibrating plate 32 can be adjusted with good precision.

On at least the bottom surface of the cavity substrate 3, formed is an insulating film (not shown), of thickness for example 0.1 μm, made of $SiO_2$ film. The $SiO_2$ film is made by plasma chemical vapor phase (Plasma CVD) using, for example, tetraethylorthosilicate tetraethoxysilane as a raw material. The insulating film is provided for preventing insulation breakdown and short circuit when the inkjet head 10 is driven. On the top surface of the cavity substrate 3 formed is an ink protective film (not shown) in the same way as that formed on the reservoir substrate 2. In addition, in the cavity substrate 3 provided is an ink supply hole 35 which communicates with the ink supply hole 27 of the reservoir substrate 2.

The electrode substrate 4 is made, for example, of a glass material of thickness approx. 1 mm. Above all, suitably used is a bolosilicate-based heat-resistant hard glass having a coefficient of thermal expansion which is close to that of the silicon material used for the cavity substrate 3. Use of bolosilicate-based heat resistance hard glass enables reducing stress which is generated between the electrode substrate 4 and the cavity substrate 3 when the electrode substrate 4 and the cavity substrate 3 are anodic bonded, since the coefficients of thermal expansion of both substrates are close to each other. As a result of this, the electrode substrate 4 and the cavity substrate 3 are strongly joined to each other without producing a problem such as stripping.

In the electrode substrate 4, concave sections 42 are respectively provided at positions on the surface opposed to the respective vibrating plates 32 of the cavity substrate 3. Each concave section 42 of depth approx. 0.3 μm is formed by etching. In addition, an individual electrode 41 generally made of indium tin oxide (ITO) of thickness, for example, 0.1 μm, is formed by sputtering in the bottom surface of each concave section 42. Accordingly an air gap G (cavity) formed between the vibrating plate 32 and the individual electrode 41 is determined by the depth of the concave section 42 and the thickness of the insulating film covering the individual electrode 41 and the vibrating plate 32. The air gap G greatly affects discharge property of the inkjet head 10. In Embodiment 1, the air gap G is set as 0.2 μm. The open end of the air gap G is sealed in air tight manner by a sealant 43 made of an epoxy adhesive or the like. This enables preventing foreign substances, moisture or the like from entering the air gap G, thereby maintaining higher reliability of the inkjet head 10.

The material for the individual electrode 41 is not limited to ITO, and indium zinc oxide (IZO) or a metal such as gold, copper or the like may be used. However, ITO is generally used because transparency of IT makes it easy to carry out confirmation of abutment condition with the vibratory plate or because of other reasons.

In addition, a terminal section 41*a* of the individual electrode 41 is exposed to an electrode take-out section 44 formed by opening the ends of the reservoir substrate 2 and the cavity substrate 3. In the electrode take-out section 44, a flexible wiring board (not shown) mounted with, for example, a drive control circuits 5 such as a driver IC is connected to the terminal section 41*a* of each electrode 41 and a common electrode 36 provided at the end of the cavity substrate 3.

An ink supply hole 45 connected to an ink cartridge (not shown) is provided in the electrode substrate 4. The ink supply hole 45 communicates with the reservoir 23 through the ink supply hole 35 provided in the cavity substrate 3 and the ink supply hole 27 provided in the reservoir substrate 2.

An operation of the inkjet head 10 structured as described above will now be explained.

Ink in the external ink cartridge (not shown) is supplied into the reservoir 23 of the inkjet head 10 through the ink supply holes 45, 35, 27. In addition, the ink passes from individual supply ports 22 through the discharge chambers 31 and the nozzle communication holes 21, and is filled to the tip of the individual nozzle holes 11. In addition, the drive control circuits 5 such as a driver IC for controlling operation of the inkjet head 10 is connected to between the individual electrodes 41 and the common electrode 36 provided in the cavity substrate 3.

Accordingly when a drive signal (pulse voltage) is supplied from the drive control circuits 5 to the individual electrode 41, pulse voltage is applied from the drive control circuit 5 to the individual electrode 41, whereby the individual electrode 41 is charged positively while the vibrating plate 32 corresponding thereto is charged negatively During this time, since electrostatic force (coulomb force) is generated between the individual electrode 41 and the vibrating plate 32, the vibrating plate 32 is attracted and deflected to the side of the individual electrode 41. As a result of this, the volume of the discharge chamber 31 is increased. Next, when pulse voltage is turned off, no electrostatic force as described above is generated, and thus the vibrating plate 32 is restored by the elastic force thereof. At this time, since the volume of the discharge chamber 31 is suddenly decreased, the pressure generated at that time causes a part of ink in the discharge chamber 31 to pass through the nozzle communication hole 21, and to be discharged from the nozzle hole 11 in the form of an ink drop. Next, when pulse voltage is applied again, the vibrating plate 32 is deflected toward the individual electrode 41, whereby the ink is supplied from the reservoir 23 into the discharge chamber 31 through the supply port 22.

In the inkjet head 10 according to Embodiment 1, pressure in the discharge chamber 31 is transmitted also to the reservoir 23 when the inkjet head 10 is driven. At this time, since the diaphragm section 100 including the resin thin film 111 is provided in the bottom wall 23*b* of the reservoir 23, the resin thin film 111 is deflected downwards in the space section 110 when positive pressure is applied into the reservoir 23. On the other hand, the resin thin film 111 is deflected upwards in the space section 110 when negative pressure is applied to the reservoir 23. Therefore, pressure fluctuation in the reservoir 23 can be buffered and pressure interference between the nozzle holes 11 can be prevented. Accordingly problems such as leak of ink from a non-driven nozzle which is not the driven nozzle or decrease in amount of discharge which is required for discharge from the driven nozzle can be eliminated.

In addition, since the resin thin film 111 is provided in the bottom wall 23*b* of the reservoir 23, the diaphragm section 100 can have a larger area and therefore pressure buffering effect can be increased.

Figure 3:
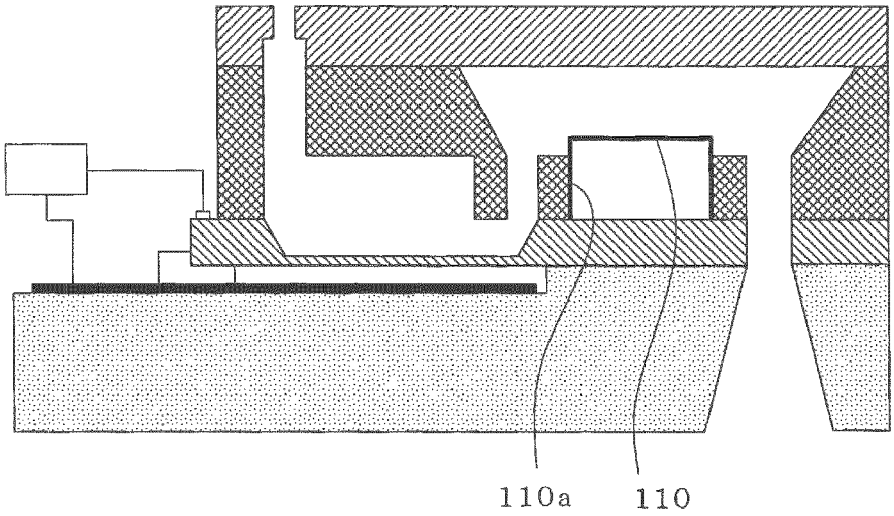
FIG. 3 shows a comparative example of a diaphragm section.

In addition, the resin thin film 111 is formed on the entire inner surface of the reservoir concave section 23*a*, and the section of the resin thin film 111 which functions the diaphragm section 100 is uniformly formed by deposition on the surface of the bottom wall 23*b* of the reservoir 23, a section of the peripheral wall of the supply ports 22 and a section of the peripheral wall of the ink supply hole 27. Therefore, a contact area with the reservoir substrate 2 increases, and thus sufficient adhesion property can be secured, compared with a case, for example, where the section of the resin thin film 111 is formed on a side surface 110*a* of the space section 110 as shown in FIG. 3.

In addition, the diaphragm section 100 is provided in the reservoir substrate 2, and the side close to the C surface thereof is covered with the cavity substrate 3 and thus is not exposed outside. Accordingly the diaphragm section 100 including the resin thin film 111 can be reliably protected from external force and there is no need for a special protective member such as protective cover, which enables reducing size and cost of the inkjet head 10.

Meanwhile, since the diaphragm section 100 has a large area as described above, it can be reliably displaced (vibrated) even in the space section 110. In addition, if necessary a small vent (not shown) which communicates the outside with the space section 110 may be provided in the cavity substrate 3 or the electrode substrate 4.

Next, a method for manufacturing the inkjet head 10 according to Embodiment 1 will be explained referring to FIGS. 4 to 10. Note that numerical values such as on thickness of the substrates, etching depth, temperature, and pressure to be shown thereafter are merely illustration of one example, and the invention is not limited by the numerical values.

First, a method for manufacturing the reservoir substrate 2 will be explained referring to FIGS. 4 to 6.

Figure 4A:
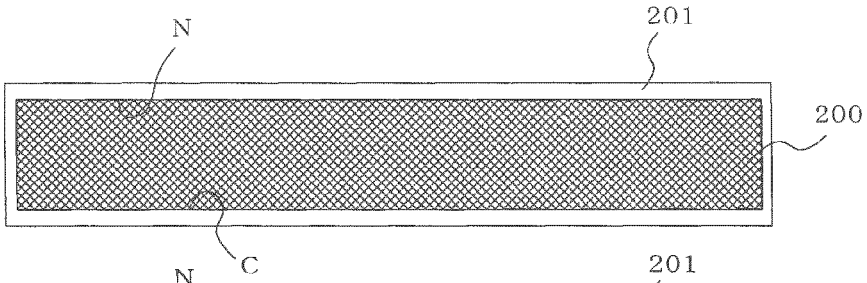
FIGS. 4A-4F are a sectional view showing a process of manufacturing a reservoir substrate of the inkjet head according to Embodiment 1.

(a) As shown in FIG. 4A, a reservoir base material 200 made of a silicon material of surface orientation (100) and thickness 180 μm is prepared, and a thermally-oxidized film 201 is formed on the outer surface of the reservoir base material 200.

Figure 4B:
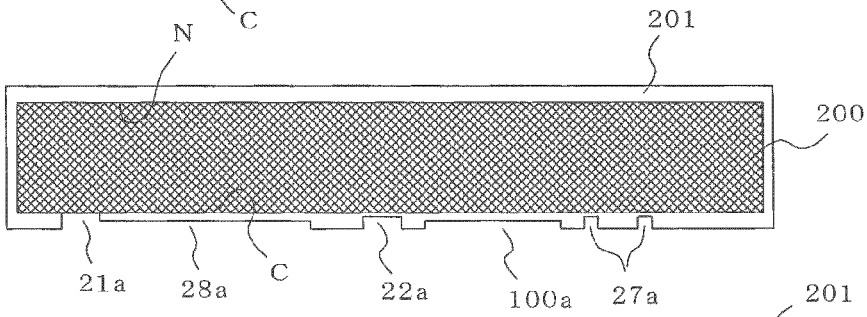

(b) Next, as shown in FIG. 4B, sections 21*a*, 28*a*, 22*a*, 100*a*, 27*a* which are exterior edges of the sections that respectively function the nozzle communication hole 21, the second concave section 28, the supply port 22, the diaphragm section 100 and the ink supply hole 27 are patterned on the surface (C surface) which is adhered to the cavity substrate 3 using the photolithography method. At this time, etching is carried out such that the following relation is satisfied among the residual film thickness of the thermally-oxidized films 201 on the C surface at the sections 21*a*, 28*a*, 22*a*, 100*a*, 27*a*.

Outer edge 21*a* of the section which functions the nozzle communication hole 21=0<The section 22*a* which functions the supply ports 22=The section 27*a* which functions the ink supply hole 27<The section 28*a* which functions the second concave section 28=The section 100*a* which functions the diaphragm section 100

Figure 4C:
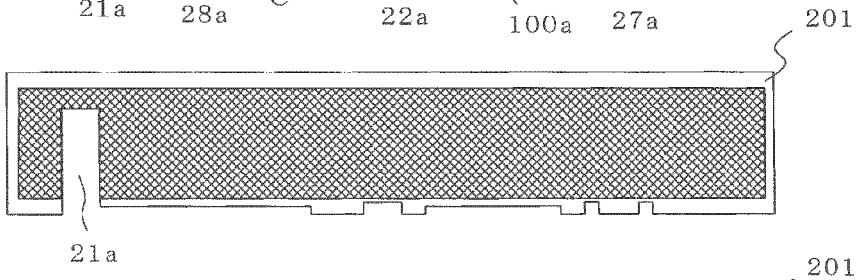

(c) Next, as shown in FIG. 4C, the section 21*a* on the C surface which functions the nozzle communication hole 21 is dry etched into approx. 150 μm using the ICP.

Figure 4D:
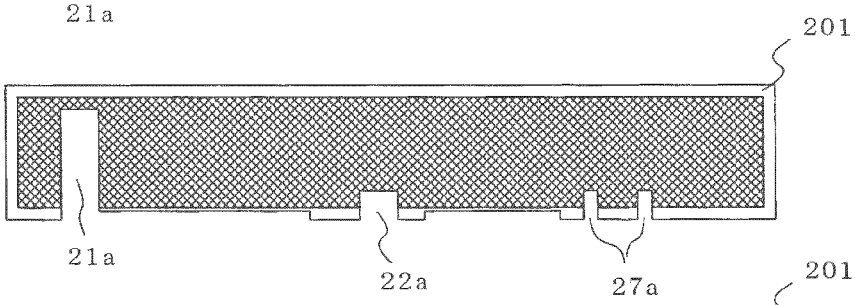

(d) Next, as shown in FIG. 4D, an appropriate amount of the thermally-oxidized film 201 is etched such that the section 22 which functions the supply port 22 and the exterior edges 27 of the section 27*a* which functions the ink supply hole 27 are opened. Subsequently dry etching is carried out approx. 15 μm using the ICP.

Figure 4E:
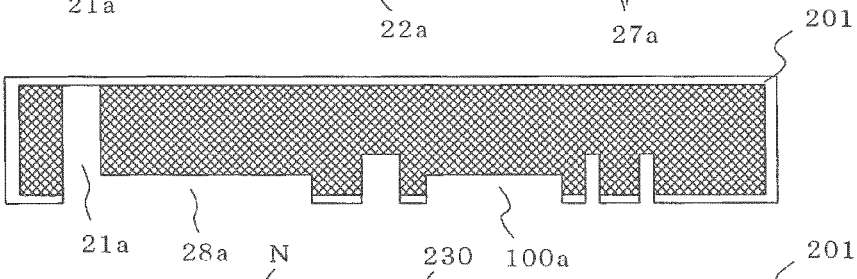

(e) Next, as shown in FIG. 4E, an appropriate amount of the thermally-oxidized film 201 is dry etched such that the section 28*a* which functions the second concave section 28 and the section 100*a* which functions the diaphragm section 100 are opened, and subsequently dry etching is carried out into approx. 25 μm using ICP. At this time, the section 21*a* which functions the nozzle communication hole 21 is also dry etched and penetrates to the N surface.

Figure 4F:
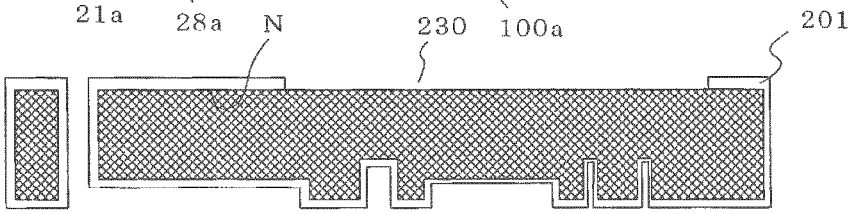

(f) Next, after the thermally-oxidized film 201 is removed, as shown in FIG. 4F, the thermally-oxidized film 201 of thickness 1.0 μm is formed again, and a section 230 which functions the reservoir concave section 23*a* is opened to the surface (N surface) adhered to the nozzle substrate 1.

Figure 5A:
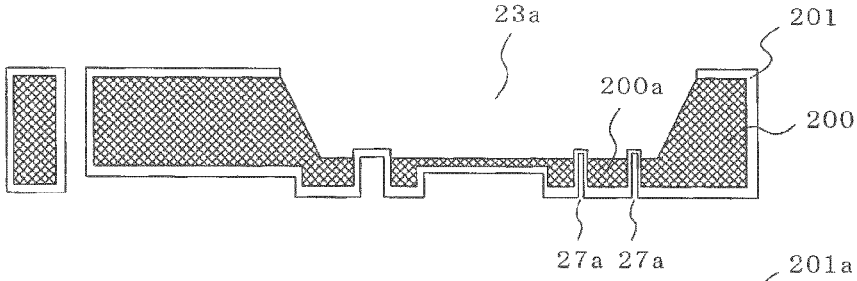
FIGS. 5A-5E are a sectional view showing a process of manufacturing a reservoir substrate following the process shown in FIGS. 4A-4F.
Figure 6A:
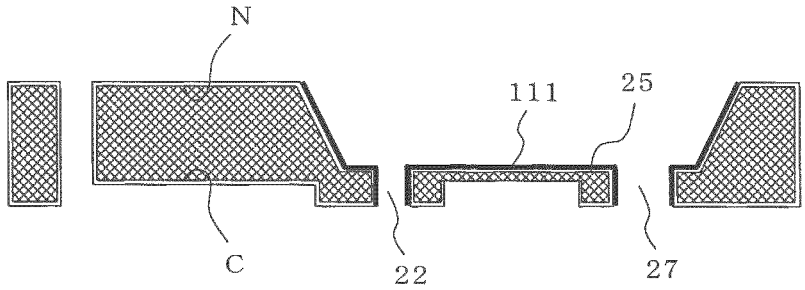
FIGS. 6A-6B are a sectional view showing a process of manufacturing a reservoir substrate following the process shown in FIGS. 5A-5E.
Figure 6B:
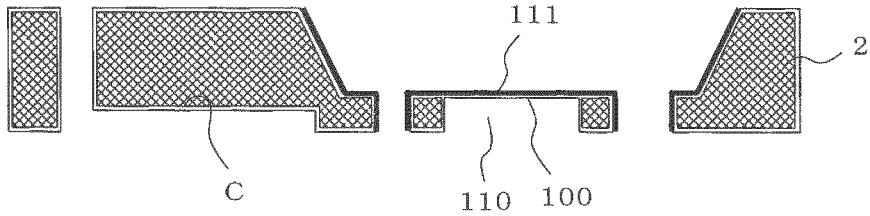

(g) Next, as shown in FIG. 5A, the reservoir concave section 23*a* is formed by wet etching with KOH into approx. 150 μm. At this time, a silicon member 200*a* of the section which functions the ink supply hole 27 is separated from the silicon base material (reservoir base material) 200 by the outer edge 27*a*.

Figure 5B:
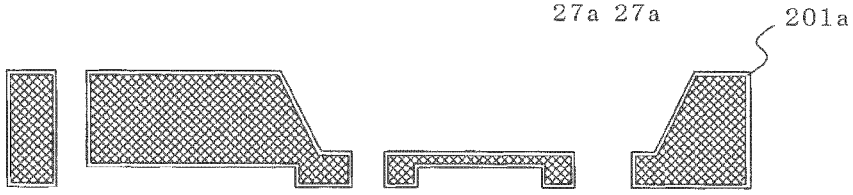
Figure 5C:
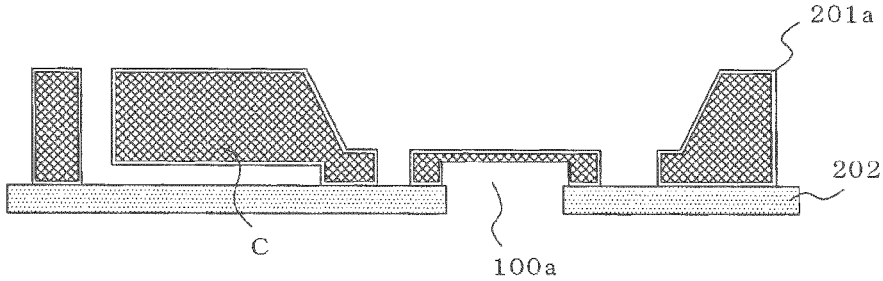
Figure 5D:
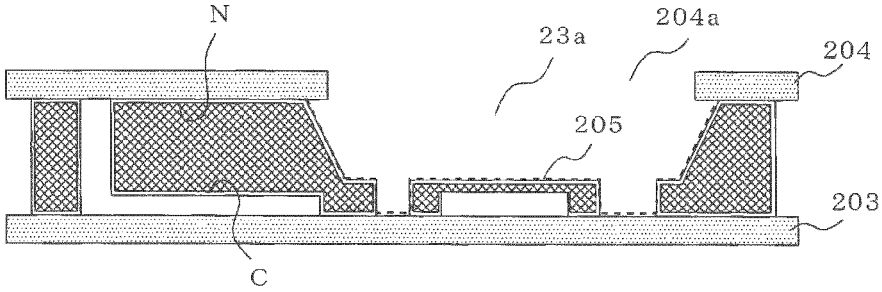
Figure 5E:
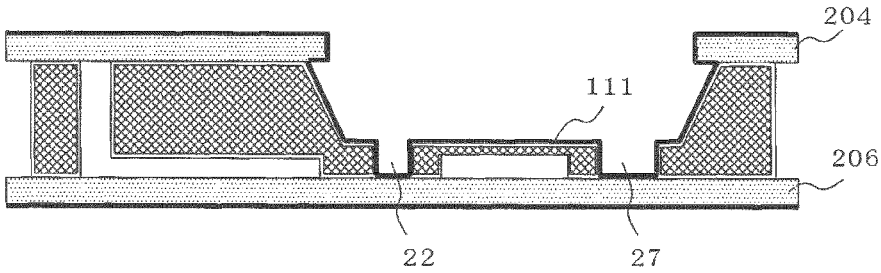

(h) After the thermally-oxidized film 201 is removed, as shown in FIG. 5B, the thermally-oxidized film 201*a* of thickness 0.2 μm is formed again.

(i) The C surface is covered with a metal or silicon mask 202 of which a section 100*a* which functions the diaphragm section 100 thereof being opened, and is dry etched such that the thermally-oxidized film 201 of the section 100*a* which functions the diaphragm section 100 is removed.

(j) Next, a platinum film 205 of thickness 0.1 μm is formed by deposition on the entire inner surface of the reservoir concave section 23*a* in the state where the entire C surface of the reservoir base material 200 is covered with a protective film 203 and the N surface of the reservoir base material 200 is protected by a protective film (mask material) 204. The protective film has an aperture 204*a* which is smaller than an aperture section of the reservoir concave section 23*a*.

In this case, the purpose of forming the aperture 204*a* of the protective film 204 smaller than the aperture section of the reservoir concave section 23*a* is to reliably protect the surface (N surface) of the nozzle substrate 1 adhered to the reservoir base material 200 with the protective film 204, thereby reliably preventing the resin thin film 111 from being formed by deposition on the adhesion interface, should there be a displacement in the alignment of the protective film 204 with respect to the reservoir base material 200. This is because when the resin thin film 111 is formed by deposition on the adhesion interface of the reservoir base material 200 with the nozzle substrate 1, sufficient adhesive strength with the nozzle substrate 1 cannot be obtained, which may lead to stripping.

(k) The protective film 203 on the C surface is replaced to a new protective film 206 (to remove the platinum film 205 on the supply port 22 and the ink supply hole 27), the substrates in this state are set in a vacuum chamber, and the resin thin film 111 of thickness 1.0 μm made of parylene is formed by deposition on the entire surface. Formation of the parylene film by deposition is formed by subliming diparaxylene (dimer) and thermally decomposing it. In this case, since the parylene film is softer than a silicon film, it provides a 100 to 1000-fold pressure absorption effect compared to the case where the section is formed by for example, a silicon film.

As described above, the resin thin film 111 is formed by deposition in a process of manufacturing the reservoir substrate 2.

(l) Next, the protective films 204, 206 on the N surface and the C surface are respectively stripped. In this case, the resin thin film 111 is formed by deposition with high adhesiveness to the surface of the reservoir concave section 23*a* caused by the action of the platinum film 205 which is formed as a underlayer film. Therefore, there is no inconvenience such as the resin thin film 111 on the inner surface section of the reservoir concave section 23*a* being stripped together with the protective film 204 when the protective film 204 is to be stripped. Next, the resin thin films 111 on the supply ports 22 and the ink supply hole 27 are removed with oxygen plasma on the side close to the C surface, and the surface is hydrophilic treated with oxygen plasma on the side close to the N surface to the extent that parylene is not removed.

(m) Silicon in the section which functions the space section 110 is removed with SF6 plasma. As a result of this, the resin thin film 111 is exposed, and thus the diaphragm section 100 is completed.

As described above, the reservoir substrate 2 is produced.

Next, a process of manufacturing the electrode substrate 4 and the cavity substrate 3 will be explained referring to FIGS. 7 to 9, and a manufacturing process until the inkjet head is completed will be explained referring to FIG. 10.

First, the electrode substrate 4 is manufactured as described below.

Figure 7A:
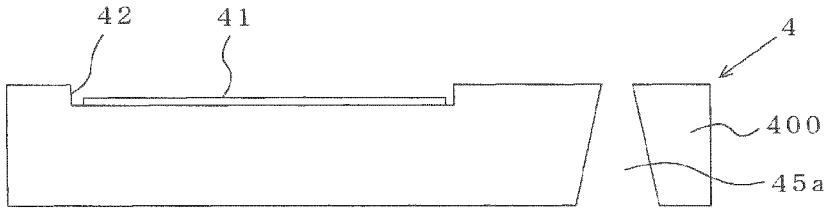
FIGS. 7A-7D are a sectional view showing a process of manufacturing an electrode substrate and a cavity substrate.

(a) As shown in FIG. 7A, the concave section 42 is formed by etching a glass substrate 400 of thickness approx. 1 mm made of borosilicate glass or the like with fluorinated acid using an etching mask made of gold and chrome. Note that the concave sections 42 are ditch shaped and slightly larger than the individual electrode 41, and a plurality of concave sections 42 are formed for each of the individual the electrodes 41.

Next, the individual electrode 41 made of indium tin oxide (ITO) is formed in the concave section 42 by sputtering and patterning.

Subsequently a section 45*a* which functions the ink supply hole 45 is formed by blasting or the like, whereby the electrode substrate 4 is produced.

Figure 7B:
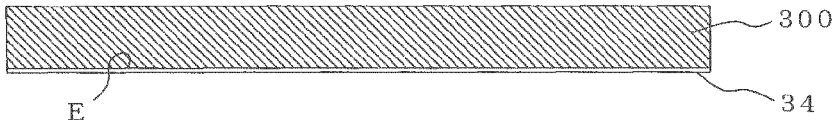

(b) Next, as shown in FIG. 7B, a cavity base material 300 made of a silicon material of thickness 220 μm is prepared. On an E surface of the cavity base material 300 which is jointed to the electrode substrate 4, formed is a boron doped layer (not shown) of a required thickness. Next, an insulating film 34 made of oxide film of thickness 0.1 μm is formed by deposition on the E surface of the cavity base material 300 by the plasma chemical vapor deposition (CVD) which uses, for example, TEOS as a raw material. For example, formation of the insulating film 34 by deposition is carried out under the following conditions: the temperature 360° C., the high frequency output 250W, the pressure 66.7 Pa (0.5 Torr), and TEOS flow rate 100 $cm^3$/min (100 sccm) and the oxygen flow rate 1,000 $cm^3$/min (1000 sccm) for the gas flow rate. In addition, it is desirable that a substance having a boron doped layer (not shown) of the required thickness be used as the cavity base material 300.

Figure 7C:
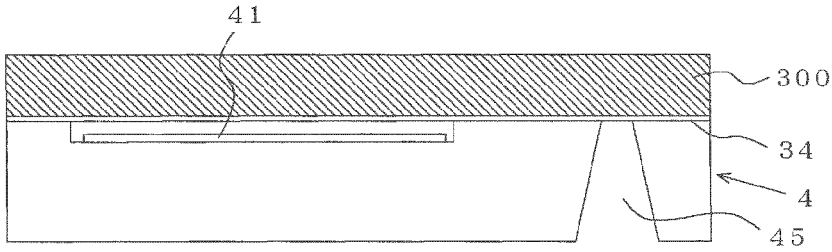

(c) Next, the cavity base material 300 (FIG. 7B) and the electrode substrate 4 (FIG. 7A) on which the individual electrode 41 is produced are anodic bonded with each other via the insulating film 34, as shown in FIG. 7C. For carrying out anodic bonding, after the cavity base material 300 and the electrode substrate 4 are heated to 360° C., the anode is connected to the cavity base material 300 and the cathode is connected to the electrode substrate 4, respectively and subsequently voltage of 800 V is applied.

Figure 7D:
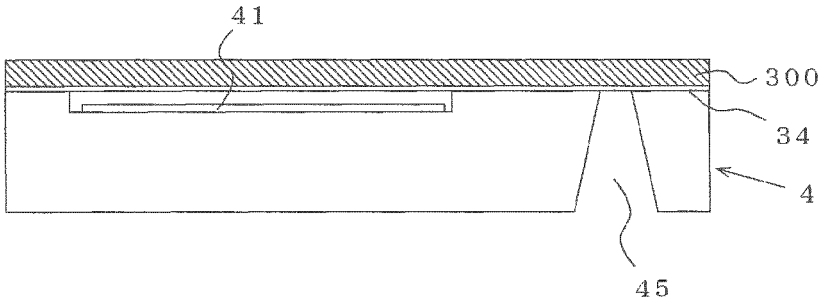

(d) Next, as shown in FIG. 7D, the surface of the anodic-bonded cavity base material 300 is ground by a back grinder and a polisher as described above. Next, the surface is etched into 10 to 20 μm with a potassium hydroxide aqueous solution so as to remove the affected layer, thereby reducing the thickness to 30 μm.

Figure 8A:
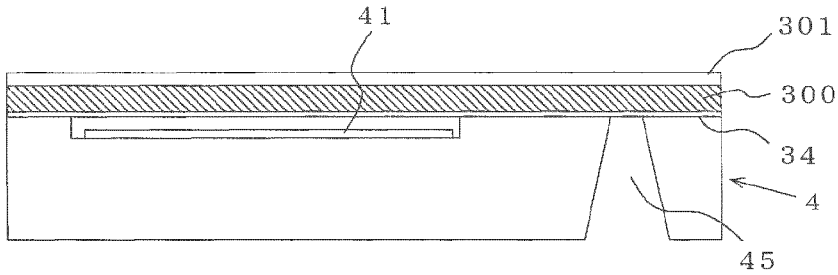
FIGS. 8A-8D are a sectional view showing a manufacturing process following the process shown in FIGS. 7A-7D.

(e) Next, as shown in FIG. 8A, a TEOS oxide film 301 of thickness approx. 1.0 μm which functions the etching mask is formed by plasma CVD on the surface of the cavity base material 300 of which thickness has been reduced.

Figure 8B:
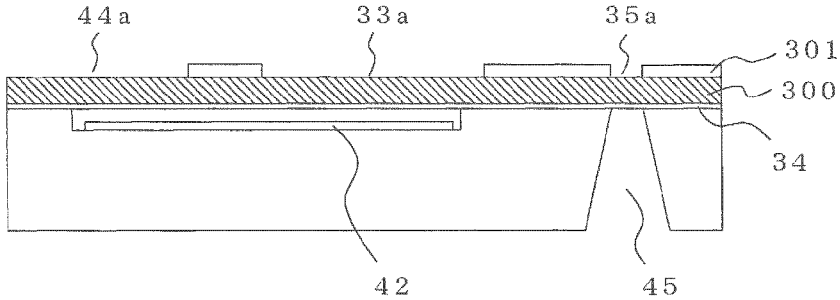

(f) In addition, a resist (not shown) is coated on the surface of the TEOS oxide film 301, and the resist is patterned by photolithography. Next, the TEOS oxide film 301 is etched, whereby sections 33*a*, 35*a*, 44*a* which function respectively the first concave section 33, the ink supply hole 35 and the electrode take-out section 44 of the discharge chamber 31 are opened, as shown in FIG. 8B. Next, the resist is stripped after the holes are opened.

Figure 8C:
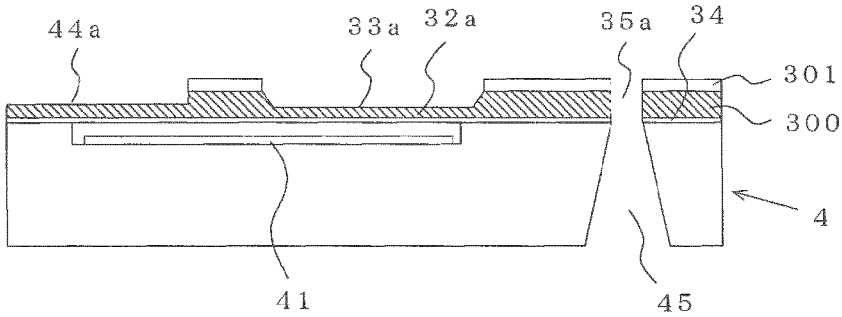

(g) Next, as shown in FIG. 8C, the anodic-bonded base material is etched with potassium hydroxide aqueous solution, whereby the section 33*a* which functions the first concave section 33 and a through-hole 35*a* which functions the ink supply hole 35 of the discharge chamber 31 are formed on the cavity base material 300 of which thickness has been reduced. At this time, since a boron-doped layer is formed on the section 44*a* which functions the electrode take-out section 44, the section 44*a* of the same thickness as the section 32*a* functioning the vibrating plate 32 remains. Although a boron-doped layer is also formed in the through-hole 35*a*, it is also exposed to potassium hydroxide aqueous solution which enters via the ink supply hole 45, and thus it disappears during etching.

In the etching process, at first, a potassium hydroxide aqueous solution in the concentration 35 wt % is used for etching until the residual thickness of the cavity base material 300 becomes for example 5 μm. Next, the potassium hydroxide aqueous solution is switched to potassium hydroxide aqueous solution in the concentration 3 wt % and etching is carried out. As a result of this, etching stop becomes sufficient enough to prevent surface roughness of the section 32*a* which functions the vibrating plate 32, and to form the section 32*a* with thickness precision of 0.80±0.05 μm. The etching stop is defined as the state where generation of air bubbles from the etching surface has stopped. In actual situations, etching is judged to be stopped when generation of air bubbles has stopped.

Figure 8D:
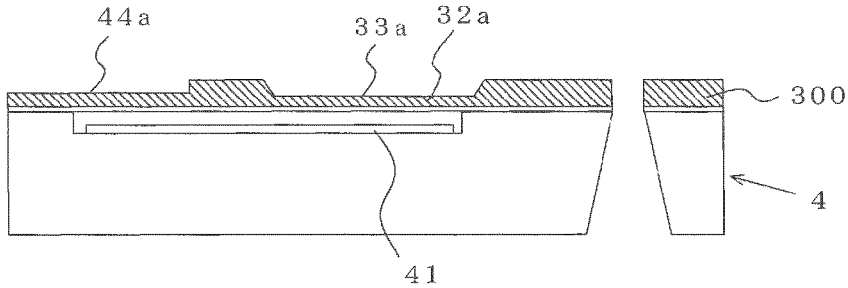

(h) After etching of the cavity base material 300 is finished, the cavity base material 300 is etched with fluorinated acid aqueous solution as shown in FIG. 8D, whereby the TEOS oxide film 301 formed on the top surface of the cavity base material 300 is removed.

Figure 9A:
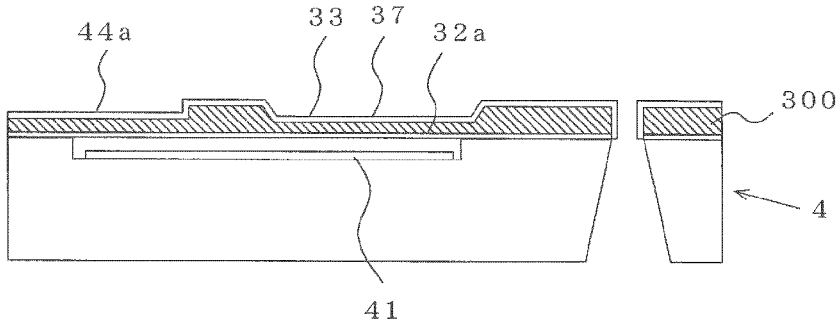
FIGS. 9A-9B are a sectional view showing a manufacturing process following the process shown in FIGS. 8A-8D.

(i) Subsequently as shown in FIG. 9A, an ink protective film 37 made of TEOS film of thickness 0.1 μm is formed by plasma CVD on the surface of the section 33*a* which functions the first concave section 33 of the cavity base material 300.

Figure 9B:
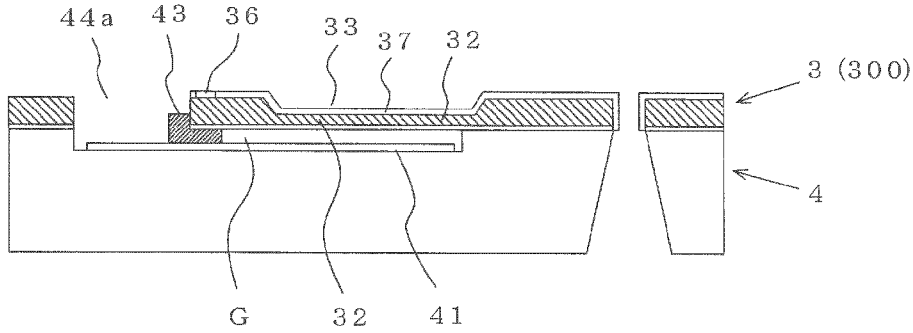

(j) Subsequently as shown in FIG. 9B, the section 44*a* which functions the electrode take-out section 44 is opened by reactive ion etching (RIE) or the like. In addition, an opening end of the air gap G between the vibrating plate 32 and the individual electrode 41 is sealed in air tight manner with the sealant 43 such as epoxy resin. In addition, the common electrode 36 made of a metal electrode such as platinum (Pt) is formed at the end of the surface of the cavity base material 300 by sputtering.

As described above, the cavity substrate 3 is produced from the cavity base material 300 in a state it is joined to the electrode substrate 4.

Figure 10A:
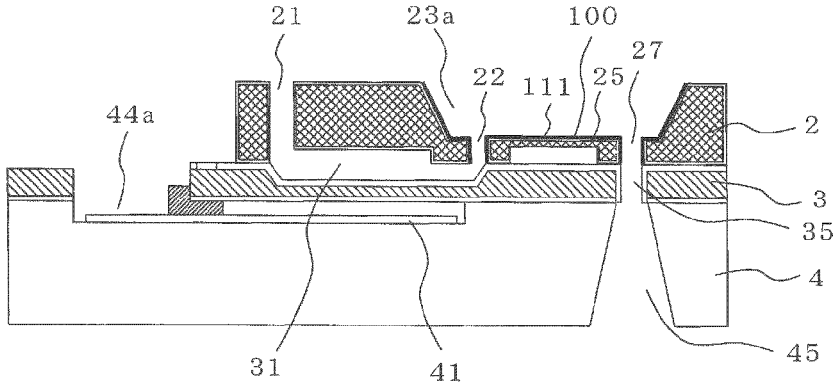
FIGS. 10A-10C are a sectional view showing a manufacturing process following the process shown in FIGS. 9A-9B.

(k) In addition, as shown in FIG. 10A, the reservoir substrate 2 in which the nozzle communication hole 21, the supply ports 22, the reservoir concave section 23*a*, the diaphragm section 100 are produced as described above is adhered to the cavity substrate 3 with an adhesive.

Figure 10B:
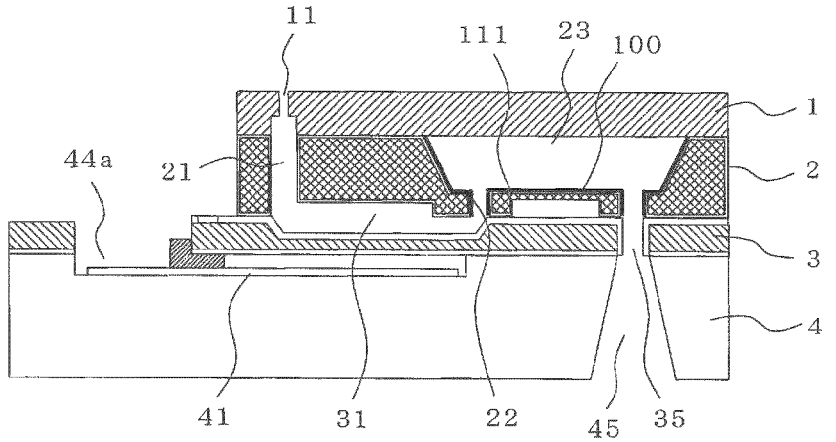

(l) Finally as shown in FIG. 10B, the nozzle substrate 1 in which the nozzle hole 11 has been formed in advance is adhered to the reservoir substrate 2 with an adhesive.

Figure 10C:
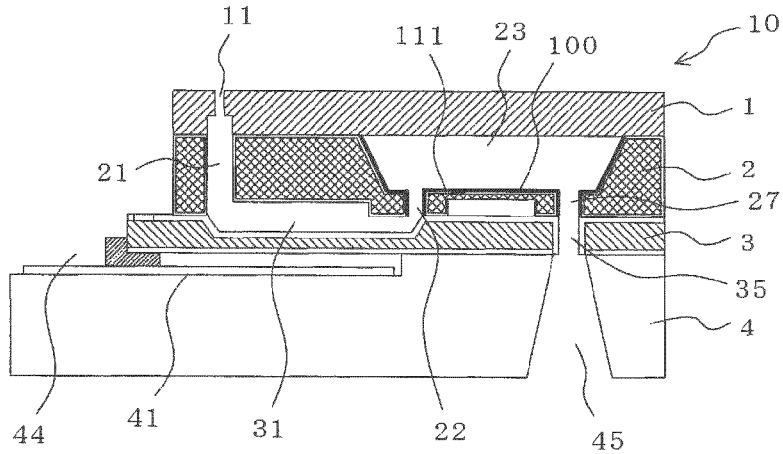

(m) Next, a main body section of the inkjet head 10 shown in FIG. 2 is produced by dividing the bonded substrates into individual heads by dicing, as shown in FIG. 10C.

As described above, in the inkjet head according to Embodiment 1, since the diaphragm section 100 and the discharge chamber 31 are provided in the separate substrates (the reservoir substrate 2 and the cavity substrate 3, respectively), the volume of the reservoir 23 can be secured. As a result of this, densification of the nozzle 11 is enabled and pressure fluctuation in the reservoir 23 can be suppressed by reducing compliance of the reservoir 23. Accordingly pressure interference which is generated between the nozzles when ink is discharged can be prevented and good discharge property can be obtained.

In addition, the diaphragm section 100 is provided in the reservoir substrate 2 such that the diaphragm section 100 is enclosed by a head chip, which prohibits external force from being applied directly As a result of this, the thickness of the diaphragm section 100 can be reduced and strength of the head unit against external force can be enhanced without a need for a special protective member such as protective cover.

In addition, the diaphragm section 100 of the reservoir substrate 2 is located on the bottom surface of the reservoir 23. Therefore, making the entire bottom surface of the reservoir 23 a diaphragm enables increasing an area of the diaphragm section 100, thereby increasing a pressure buffering effect of the diaphragm section 100.

In addition, since the diaphragm section 100 is formed by forming of the resin thin film 111 by deposition, the diaphragm section 100 can be formed all at once on the wafer, and thus good productivity can be obtained.

In addition, the diaphragm section 100 is formed by formation of the resin thin films 111 by deposition in the state where the side closer to the N surface of the reservoir substrate 2 is protected by the protective film 204 having the aperture 204*a*, and subsequently by stripping the protective film 204. In other words, a part of the resin thin film 111 which is formed by deposition on the entire inner surface of the reservoir concave section 23*a* is utilized as the diaphragm section 100 as it is. Therefore, there is no need for a process of partially removing the resin thin film 111 or partially forming the resin thin film 111, which makes the manufacturing process easier and improves yield and productivity In addition, the space section 110 used for deformation of the diaphragm section 100 is formed by etching by engraving the surface opposite to the surface in which the reservoir 23 is formed. Therefore, there is no need for processing the cavity substrate 3 or the nozzle substrate 1 when providing the space section 110, and thus design and processing of the cavity substrate 3 or the nozzle substrate 1 are not affected.

In addition, since parylene is used for the resin thin film 111, a resin thin film free from minute defects and with superior coating property high heat resistance, chemical resistance and vapor resistance can be formed. In addition, a 100 to 1000-fold pressure absorption effect can be provided compared to the case where the thin film section of the diaphragm section 100 is formed by for example, a silicon film.

Furthermore, the protective film 204 for protecting the N surface when forming the resin thin film 111 by deposition is structured such that the aperture 204*a* thereof is smaller than the aperture section of the reservoir concave section 23*a*. Therefore, should there be a displacement in the alignment of the protective film 204 with respect to the reservoir substrate 2, the adhesion interface (N surface) of the reservoir substrate 2 to the nozzle substrate 1 can be reliably protected by the protective film 204, whereby formation of the resin thin film 111 can be reliably protected on the adhesion interface. This secures adhesive strength between the reservoir substrate 2 and the nozzle substrate 1. In addition, since the side closer to the C surface of the reservoir substrate 2 is also protected by the protective film 206 in a similar way adhesive strength between the reservoir substrate 2 and the cavity substrate 3 can also be secured.

In addition, since the platinum film 205 is formed by deposition as the underlayer film prior to formation of the resin thin film 111 by deposition, adhesiveness between the resin thin film 111 and the silicon surface can be secured.

In addition, since the surface of the resin thin film 111 is hydrophilic treated with oxygen plasma, hydrophilicity of the ink flow path can be readily secured.

In addition, since SF6 plasma is used for dry etching of silicon when forming the diaphragm section 100, damage given to the resin thin film 111 is suppressed to the minimum when dry etching on silicon is carried out.

In addition, the structure is such that the space section 110 is provided on the side of the adhesion interface between the cavity substrate 3 and the reservoir substrate 2. In other words, the structure is such that the discharge chamber 31 and the reservoir 23 are formed on the opposite sides on the surfaces of the reservoir substrate 2, respectively. Therefore, the reservoir 23 is made vertically overlapped with the discharge chamber 31 of the cavity substrate 3 and the area of the head can be reduced.

Embodiment 2

Figure 11:
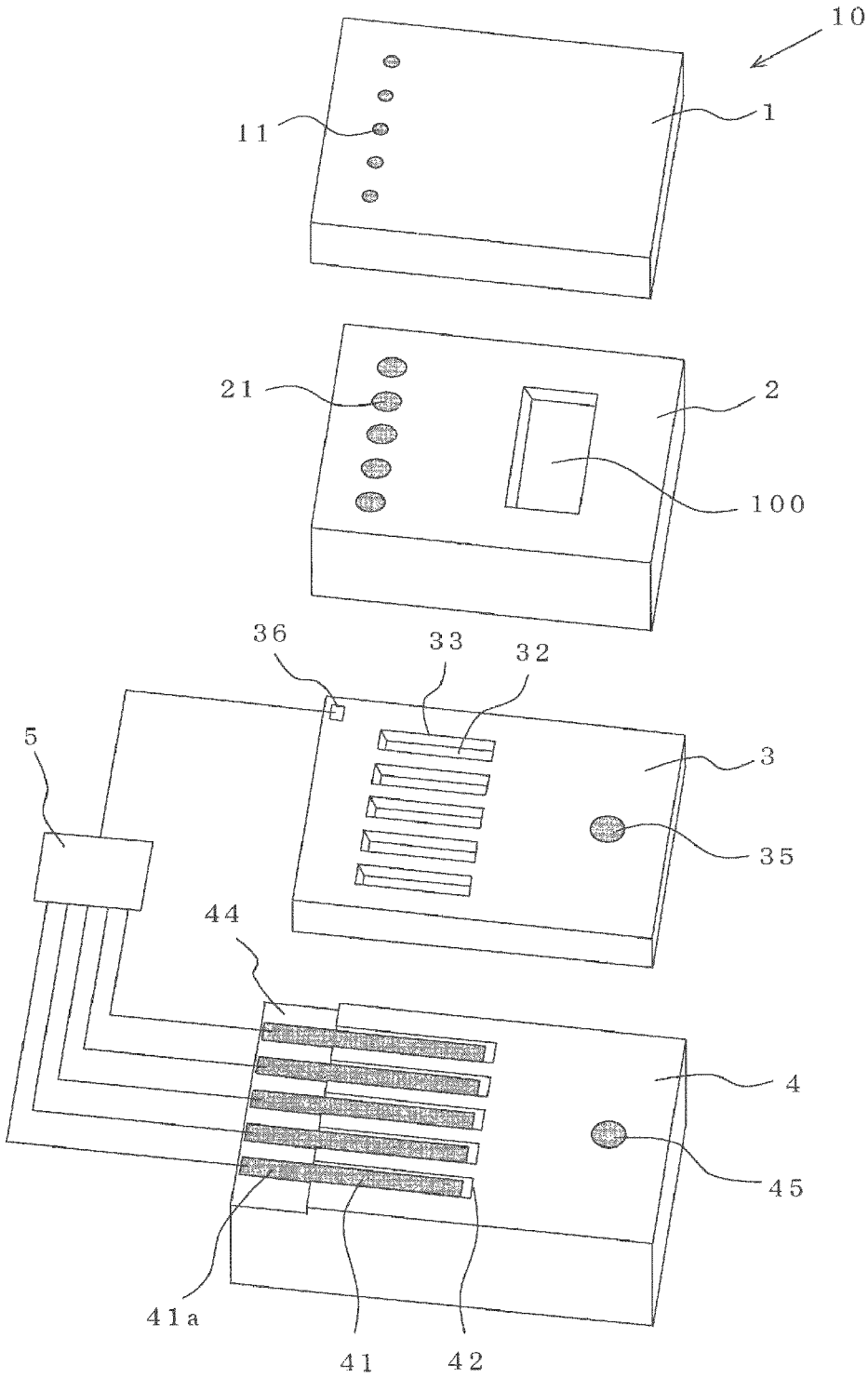
FIG. 11 is an exploded perspective view showing a schematic structure of an inkjet head according to Embodiment 2 of the invention.
Figure 12:
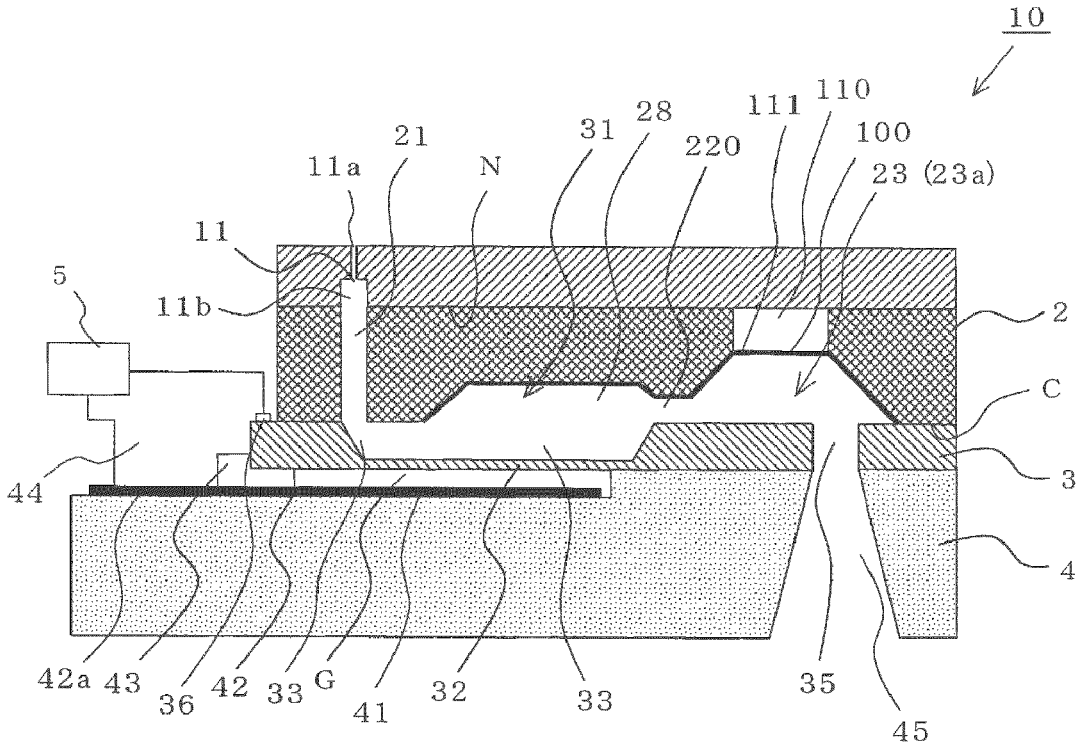
FIG. 12 is a sectional view showing an assembled state of the inkjet head shown in FIG. 11.

FIG. 11 is an exploded perspective view showing the schematic structure of an inkjet head according to an Embodiment 2 of the invention, and FIG. 12 is a longitudinal sectional view showing the assembled state of the inkjet head which is shown in FIG. 11. Note that the same numerals are provided to the sections which are the same as Embodiment 1.

In the inkjet head 10 according to Embodiment 2, the diaphragm section 100 in the reservoir substrate 2 is provided on the side of the adhesion interface with a nozzle substrate 1 (on the side of the C surface), which is contrary to Embodiment 1.

In Embodiment 2, members except the reservoir substrate 2, that is, the nozzle substrate 1, the cavity substrate 3 and the electrode substrate 4 have the same structure as Embodiment 1. In the reservoir substrate 2 of Embodiment 2, formed are the cylindrical nozzle communication holes 21 which respectively communicate with the nozzle holes 11 in the nozzle substrate 1 in a similar way In Embodiment 1, the second concave section 28 which includes a part of each discharge chamber 31 and the reservoir concave section 23*a* which functions the reservoir 23 are formed on the opposite sides of the reservoir substrate 2. In Embodiment 2, however, they are formed on the same surface (on the C surface). In addition, on the C surface of the reservoir substrate 2, further formed is the narrow-ditch shaped supply port 220 which communicates the second concave section 28 with the reservoir concave section 23*a*. In addition, the ink supply hole 35 provided in the cavity substrate 3 is opened to the aperture surface of the reservoir concave section 23*a*.

The reservoir concave section 23*a* of the reservoir substrate 2 has a substantially trapezoid section which is opened to the adhesion interface with the nozzle substrate 1 (the C surface) with the diameter being larger on the side of the adhesion interface. In addition, on the upper portion (on the side closer to the N surface) of the reservoir concave section 23*a*, formed is the rectangular-prism shaped space section 110. In addition, the resin thin film 111 is formed in the space section 110 so as to constitute the diaphragm section 100 which serves as the pressure fluctuation buffering section.

In the embodiment, the resin thin film 111 is formed on the inner surfaces of the second concave section 28, the supply ports 220 and the reservoir concave section 23*a* as well as the side closer to the C surface of the space section 110. In addition, the resin thin film 111 at the section opposed to the space section 110 is floated in the air between the space section 110 and the reservoir concave section 23*a*. The space section 110 permits deflection of the resin thin film 111.

The resin thin film 111 is formed, for example, using parylene as in the same manner as Embodiment 1.

Furthermore, as is the case with Embodiment 1, the resin thin film 111 is not formed on the surface (the C surface here) of the reservoir substrate 2 which functions the adhesion interface with another substrate. Accordingly adhesive strength with the cavity substrate 3 is secured.

The inkjet head 10 according to Embodiment 2 vibrates in the vertical direction when it is driven, with the resin thin film 111 of the diaphragm section 100 provided on the side closer to the N surface of the reservoir 23 having a large area. Therefore, Embodiment 2 provides a similar effect as Embodiment 1 and can prevent pressure interference between the nozzles 11.

In addition, the diaphragm section 100 is formed inside of the reservoir substrate 2, and the side closer to the N surface of the diaphragm section 100 is covered with the nozzle substrate 1 and thus is not exposed to the outside. Therefore, the diaphragm section 100 including the resin thin film 111 can be reliably protected from external force and there is no need for a protective cover such as a special protective member. Accordingly the size of the inkjet head 10 and cost thereof can be reduced.

Next, a method for manufacturing the reservoir substrate which is used for manufacturing the inkjet head according to Embodiment 2 will be explained referring to FIGS. 13, 14.

Figure 13A:
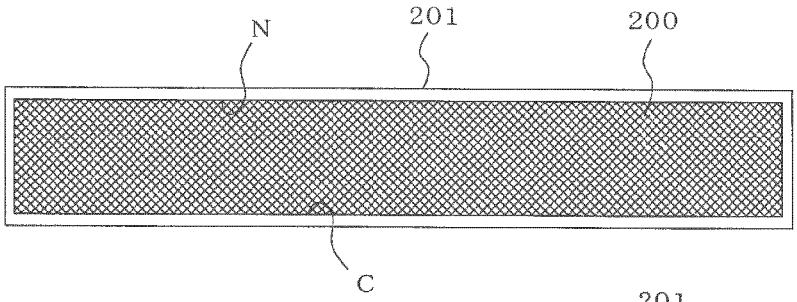
FIGS. 13A-13E are a sectional view showing a process of manufacturing a reservoir substrate of the inkjet head according to Embodiment 2.

(a) First, as shown in FIG. 13A, a reservoir base material 200 made of a silicon material of surface orientation (100) and thickness 180 μm is prepared, and the thermally-oxidized film 201 of thickness 1.0 μm is formed on the outer surface of the reservoir base material 200.

Figure 13B:
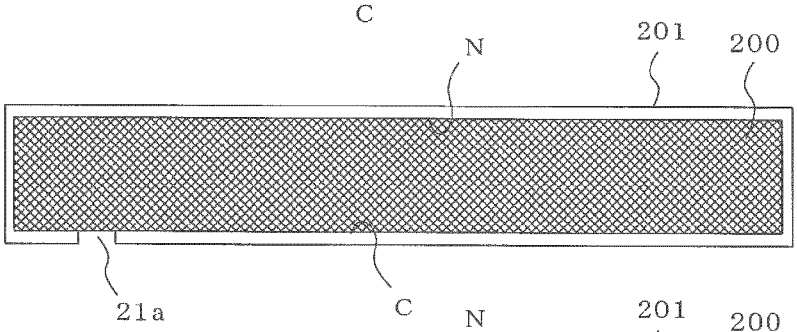

(b) Next, as shown in FIG. 13B, the section 21*a* which functions the nozzle communication hole 21 is opened to the C surface by the photolithography method.

Figure 13C:
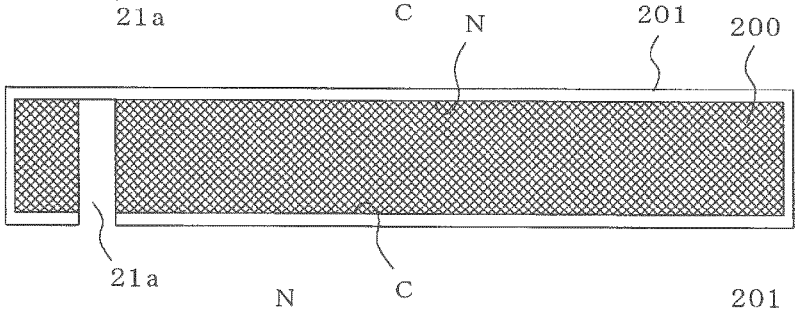

(c) Next, as shown in FIG. 13C, the section 21*a* which functions the nozzle communication hole 21 to the C surface is dry etched by the ICP until the section penetrates the reservoir base material 200.

Figure 13D:
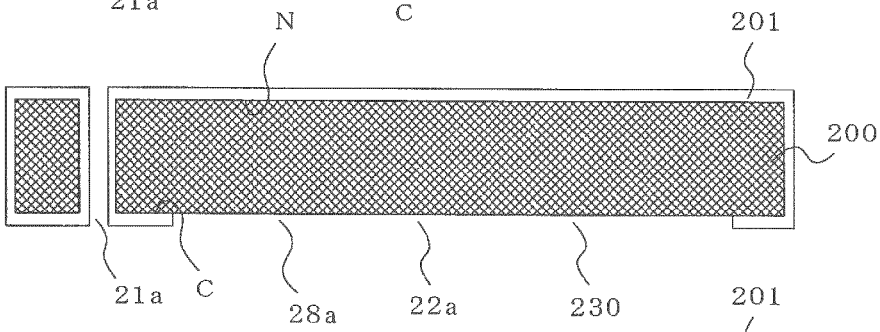

(d) Next, the thermally-oxidized film 201 is stripped. Subsequently as shown in FIG. 13D, the thermally-oxidized film 201 is formed again. Next, the sections 230, 22*a*, 28*a* which function the reservoir concave section 23*a*, the supply ports 220 and the second concave section 28 are respectively patterned on the C surface. Provided that the following relation on the pattern width is satisfied depending on the etching depth.

The section 230 which functions the reservoir concave section 23*a*>The section 28*a* which functions the second concave section 28>The section 22*a* which functions the supply ports 220.

Figure 13E:
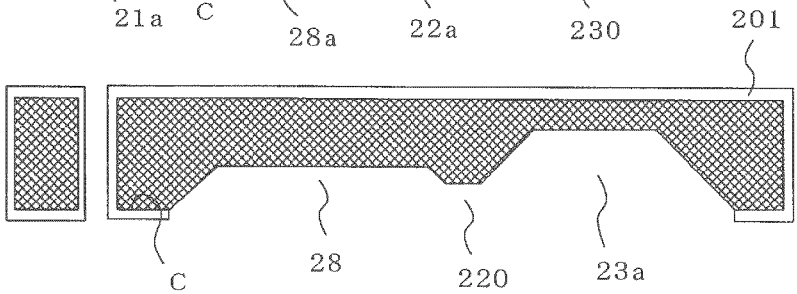

(e) Next, as shown in FIG. 13E, the C surface is etched into 150 μm by wet etching with KOH so as to form the reservoir concave section 23*a*. During the etching, although both the supply port 220 and the second concave section 28 are formed simultaneously etching is stopped at depths corresponding to the aperture widths of the sections patterned by the thermally-oxidized film 201, respectively. The following relation is satisfied on the depth of each section.

The reservoir concave section 23*a*>The second concave section 28>The supply port 220

Figure 14A:
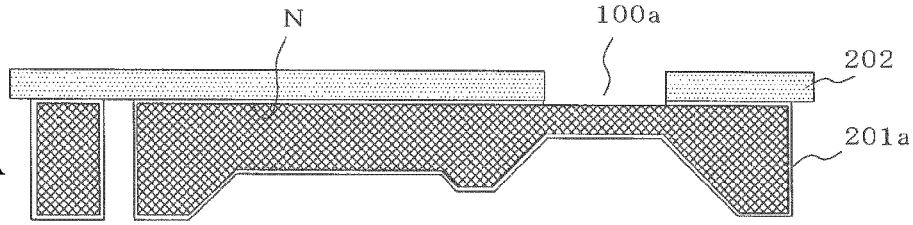
FIGS. 14A-14E are a sectional view showing a process of manufacturing a reservoir substrate following the process shown in FIGS. 13A-13E.

(f) Next, the thermally-oxidized film 201 is stripped. Subsequently as shown in FIG. 14A, the thermally-oxidized film 201 is formed again. Next, the N surface is covered with a metal or silicon mask 202 of which only the section 100*a* which functions the diaphragm section 100 is opened. Subsequently the N surface with the mask 202 is dry etched so as to remove the thermally-oxidized film 201 on the section 100*a* which functions the diaphragm section 100.

Figure 14B:
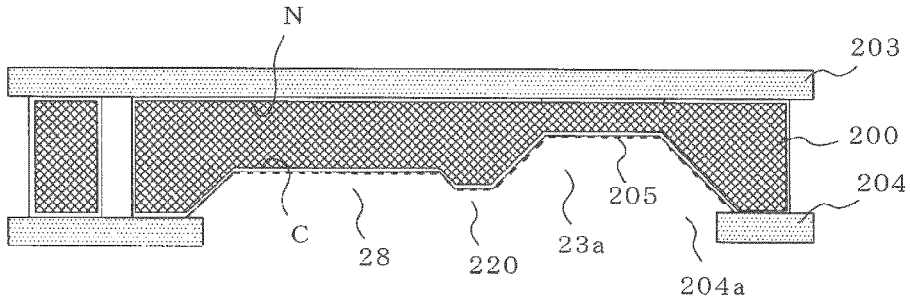
Figure 14C:
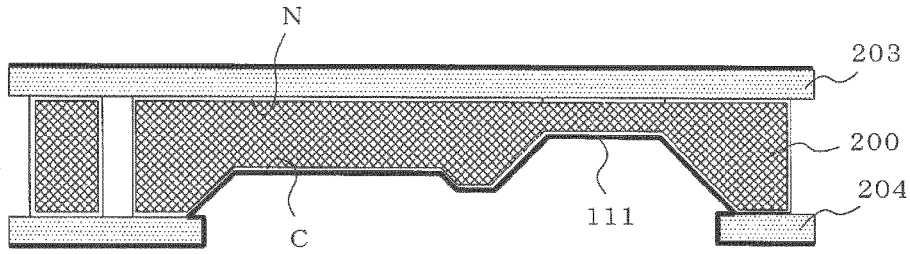

(g) Subsequently the platinum film 205 of thickness 0.1 μm is formed on the entire inner surfaces of the second concave section 28, the supply port 220, and the reservoir concave section 23*a*. The platinum film 205 is formed in the state where, as shown in FIG. 14B, the entire N surface of the reservoir base material 200 is masked with the protective film 203 and the C surface of the reservoir base material 200 is protected by the protective film 204. The protective film 204 has the aperture 204*a* which is smaller than the aperture sections of the second concave section 28, the supply port 220, and the reservoir concave section 23*a*.

(h) The resin thin film 111 made of parylene of 1.0 μm is formed by deposition while the N surface and the C surface are protected by the protective films 203, 204, respectively. Formation of the parylene film by deposition is carried out by setting the reservoir base material 200 covered with the protective films 203, 204 in a vacuum chamber, and subliming diparaxylene (dimer) for decomposing, thereby depositing the films on the entire surface, as is the case with Embodiment 1.

As described above, the resin thin film 111 is formed by deposition in a process of manufacturing the reservoir substrate 2.

Figure 14D:
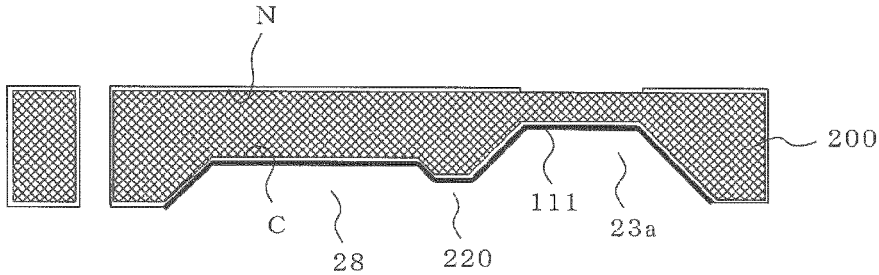
Figure 14E:
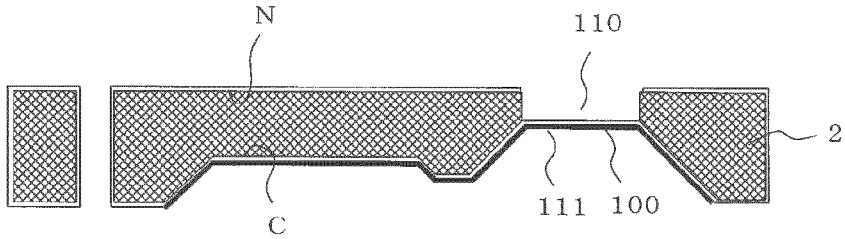

(i) Next, as shown in FIG. 14D, the protective films 203, 204 on the N surface and the C surface are respectively stripped. At this time, as is the case with Embodiment 1, the resin thin film 111 is formed by deposition with high adhesiveness to the surfaces of the second concave section 28, the supply ports 220 and the reservoir concave section 23*a* because of operation of the platinum film 25. Therefore, no inconvenience occurs such as stripping of the resin thin film 111 together with the protective film 204 when the protective film 204 on the side closer to the C surface is stripped. Next, the surface closer to the C surface is hydrophilic treated with oxygen plasma to the extent that parylene is not removed.

(j) Silicon at the section which functions the space section 110 is removed with SF6 plasma on the N surface. As a result of this, the resin thin film 111 is exposed, and the diaphragm section 100 is completed.

As described above, the reservoir substrate 2 is produced.

Next, by using the reservoir substrate 2 which has been produced as described above for manufacturing referring to FIGS. 7 to 10 for Embodiment 1, the inkjet head 10 according to Embodiment 2 can be manufactured.

The inkjet head 10 according to Embodiment 2 provides a substantially similar effect as Embodiment 1, and has a structure in which the space section 110 used for deforming the diaphragm section 100 is provided on the side of the adhesion interface with the nozzle substrate 1. In other words, the inkjet head 10 is structured such that the reservoir 23 and other sections are formed on the same side of the reservoir substrate 2. Therefore, all processing for the reservoir substrate 2 can be completed with processing on a single side which is closer to the cavity substrate 3, whereby yield and productivity can be improved.

In Embodiment 1, parylene is used for the resin thin film 111. However, other materials such as cytop may be used.

Figure 15:
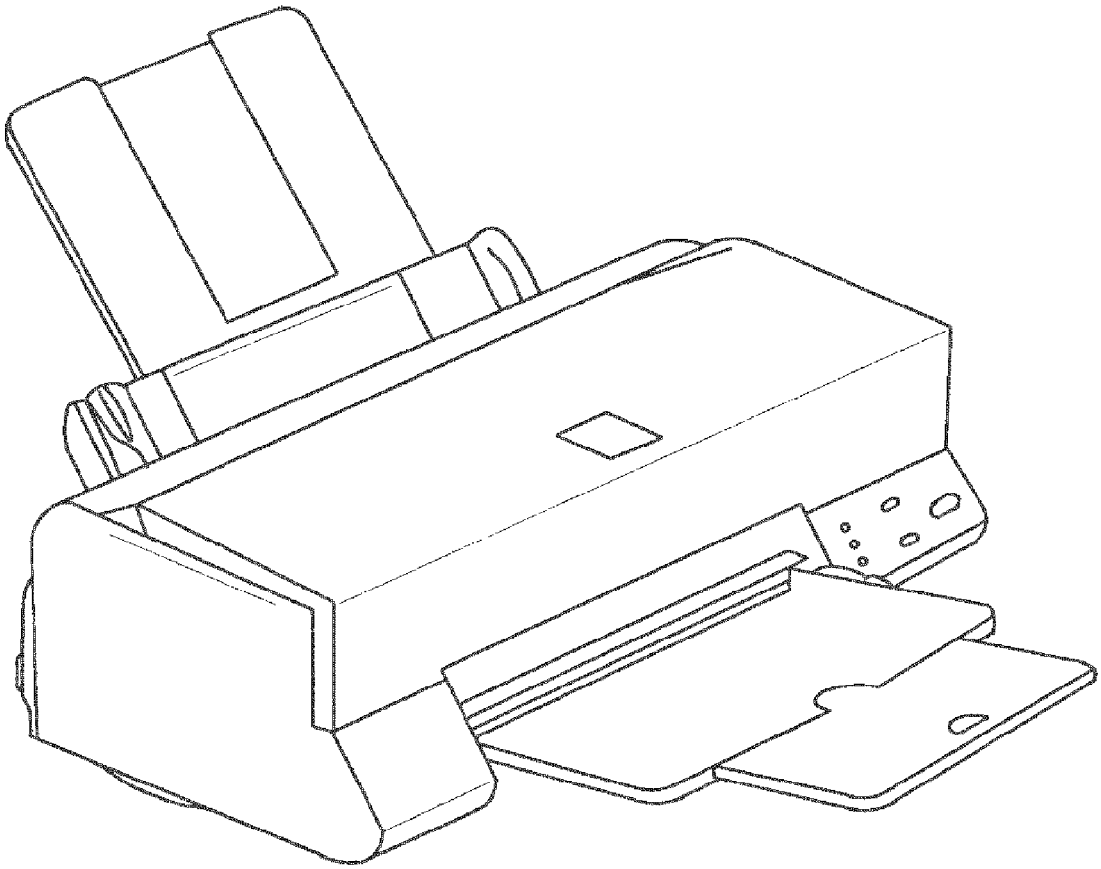
FIG. 15 is a perspective view showing an inkjet printer according to the invention.

In Embodiments 1 and 2, an inkjet head of electrostatic-drive type and the method for manufacturing it have been described. However, the invention is not limited to the embodiments as described above, and various modifications are possible within the scope of the technological concept of the invention. For example, the invention may also be applied to an inkjet head which employs a drive type other than the electrostatic drive type. In the case of a piezoelectric type, what is needed is only to adhere a piezoelectric element in place of the electrode substrate to the bottom section of each discharge chamber. In the case of a bubble type, what is needed is only to provide a heating element in each discharge section. In addition, the inkjet head 10 according to the embodiments as described above may be applied to droplet discharging apparatuses of various applications in addition to the ink jet printer shown in FIG. 15 by changing a droplet in various ways. The applications of the droplet discharging apparatuses include production of a color filter of a liquid crystal display formation of the emission section of an organic electro-luminescence display unit, formation of the wiring section of the wiring board to be manufactured by a printed circuit board manufacturing apparatus, and discharge of biologic liquid (production of protein chips and DNA chips). In addition, a droplet discharging apparatus including the inkjet head (droplet discharging head) according to Embodiments 1 and 2 as described above can be a droplet discharging apparatus including a droplet discharging head which prevents pressure interference between nozzles which is generated when droplets are discharged and which has good discharge property.

What is claimed is:

1. A droplet discharging head comprising:

a nozzle substrate that has a plurality of nozzle holes;

a cavity substrate that communicates with the nozzle holes and has a plurality of independent discharge chambers, the discharge chambers generating pressure therein so as to discharge droplets through the nozzle holes;

a reservoir substrate that has a reservoir concave section and is provided between the nozzle substrate and the cavity substrate, the reservoir concave section functioning a reservoir, the reservoir being shared for communicating with the discharge chambers;

a resin thin film formed on an entire inner surface of the reservoir concave section by film deposition, the resin thin film not being formed in the reservoir substrate on a side of an adhesion interface with the nozzle substrate or the cavity substrate; and a bottom surface of the reservoir concave section functioning a diaphragm section, the diaphragm section including the resin thin film and buffering pressure fluctuation.

2. The droplet discharging head according to claim 1, wherein a side opposite to the reservoir concave section of the reservoir substrate at the section of the resin thin film which includes the bottom surface of the reservoir concave section functions a space section which is formed by engraving the surface opposite to the surface in which the reservoir concave section is formed into the diaphragm section.

3. The droplet discharging head according to claim 2, wherein a metal thin film is formed as an underlayer of the resin thin film.

4. The droplet discharging head according to claim 3, wherein the metal thin film is a platinum film.

5. The droplet discharging head according to claim 2, wherein the space section is provided in the reservoir substrate on a side of an adhesion interface with the cavity substrate.

6. The droplet discharging head according to claim 2, wherein the space section is provided in the reservoir substrate on a side of an adhesion interface with the nozzle substrate.

7. The droplet discharging head according to claim 1, wherein the resin thin film is made of parylene.

8. A droplet discharging apparatus comprising a droplet discharging head according to claim 1.

9. A method for manufacturing a droplet discharging head including: a nozzle substrate which has a plurality of nozzle holes; a cavity substrate which has a plurality of independent discharge chambers, the discharge chambers communicating with the nozzle holes respectively and generating pressure therein so as to discharge droplets through the nozzle holes; a reservoir substrate which has a reservoir and which is provided between the nozzle substrate and the cavity substrate, the reservoir being shared for communicating with the discharge chambers; and a diaphragm section which includes a resin thin film in a bottom surface of the reservoir, the resin thin film buffering pressure fluctuation, the method comprising:

forming a reservoir concave section which functions the reservoir by wet etching on a surface on one side of a silicon base material which functions the reservoir base material;

covering a surface of a section other than an aperture section of the reservoir concave section on one side and the opposite side of the silicon base material with a mask material so as to form a resin thin film on an entire inner surface of the reservoir concave section;

removing the mask material; and removing the silicon base material by dry etching on the surface on the opposite side until the resin thin film is exposed so as to form the diaphragm section.

10. The method for manufacturing a droplet discharging head according to claim 9, wherein the step of forming the resin thin film is a step of depositing parylene.

11. The method for manufacturing a droplet discharging head according to claim 10, wherein the mask material which covers the one side of the silicon base material has an aperture only at a position opposed to the aperture section of the reservoir concave section, and the aperture is smaller than the aperture section of the reservoir concave section.

12. The method for manufacturing a droplet discharging head according to claim 10, further comprising forming a metal thin film by deposition as an underlayer film before forming a parylene film by deposition.

13. The method for manufacturing a droplet discharging head according to claim 12, wherein the step of forming a metal thin film is a step of sputtering platinum.

14. The method for manufacturing a droplet discharging head according claim 10, wherein a surface of the parylene thin film is hydrophilic treated with oxygen plasma.

15. The method for manufacturing a droplet discharging head according to claim 10, wherein SF5 plasma is used for the dry etching which is carried out when forming the diaphragm section.

16. A method for manufacturing a droplet discharging apparatus, wherein the droplet discharging apparatus is manufactured applying a method for manufacturing the droplet discharge head according to claim 9.

* * * * *